US005115946A

United States Patent [19]

Libit

[11] Patent Number: 5,115,946

[45] Date of Patent: May 26, 1992

[54] SQUEEZE BOTTLE

[76] Inventor: Sidney M. Libit, 441 Lakeside Ter., Glencoe, Ill. 60022

[21] Appl. No.: 653,508

[22] Filed: Feb. 11, 1991

[51] Int. Cl.[5] ..... B67D 5/00

[52] U.S. Cl. ..... 222/145; 222/211; 222/212; 222/488; 239/327; 239/391; 239/394

[58] Field of Search ..... 222/209, 211, 212, 145, 222/464, 481, 488, 630–633, 637; 239/327, 390, 391, 392, 394

[56] References Cited

U.S. PATENT DOCUMENTS

| | | | |
|---|---|---|---|
| 3,369,713 | 2/1968 | Godschalk, Jr. | 239/327 |
| 3,381,860 | 5/1968 | Armour | 239/327 |
| 3,851,800 | 12/1974 | Swain | 222/145 |
| 4,087,023 | 5/1978 | Szczepanski | 222/212 |
| 4,401,270 | 8/1983 | McKinney | 239/327 |
| 4,408,703 | 10/1983 | Libit | 222/284 |
| 4,429,815 | 2/1984 | Libit | 222/452 |
| 4,600,130 | 7/1986 | Libit | 222/464 |

*Primary Examiner*—Michael S. Huppert
*Assistant Examiner*—Philippe Derakshani
*Attorney, Agent, or Firm*—Hill, Van Santen, Steadman & Simpson

[57] ABSTRACT

A squeeze bottle which eliminates a separate tube and has no moving parts and has two positions for filling and for use for dispensing and mixing with air such products as soap, cosmetics, food, mustard, salad dressing and so forth. The squeeze bottle mixes the material because the supply tube extends from the bottom of the container and it is not necessary to shake before using.

5 Claims, 1 Drawing Sheet

SQUEEZE BOTTLE

CROSS-REFERENCES TO RELATED APPLICATIONS

The present application is related to Design application Ser. No. 594,991, filed Oct. 4, 1990 in which the inventor is Sidney M. Libit.

BACKGROUND OF THE INVENTION

1Field of the Invention

This invention relates in general to dispenser bottles and particularly to a novel squeeze bottle.

2. Description of Related Art

Various dispensing bottles are known such as shown in U.S. Pat. Nos. 4,408,703 and 4,429,815. Such structure requires a separate tube which extends into the container.

SUMMARY OF THE INVENTION

The present invention relates to a novel squeeze bottle which has a dispensing tube which is integrally formed with the bottle and which extends on the outside thereof and is attached to the outer surface of the bottle and which has a receiving end that extends into the container. When the bottle is squeezed, the product is forced up through the dispensing tube to a discharge nozzle which can emit the product mixed with air so as to form a spray.

The dispensing nozzle can be rotated to different positions so as to selectively vary the quantity of product and air which is dispensed.

Cosmetics, liquid soaps, lotions, shampoos, and food such as any liquid food product such as oil, ketchup, mustard, and cleaners such as window cleaners, detergents and wax can be dispensed with the novel dispensing container of the invention.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 1:
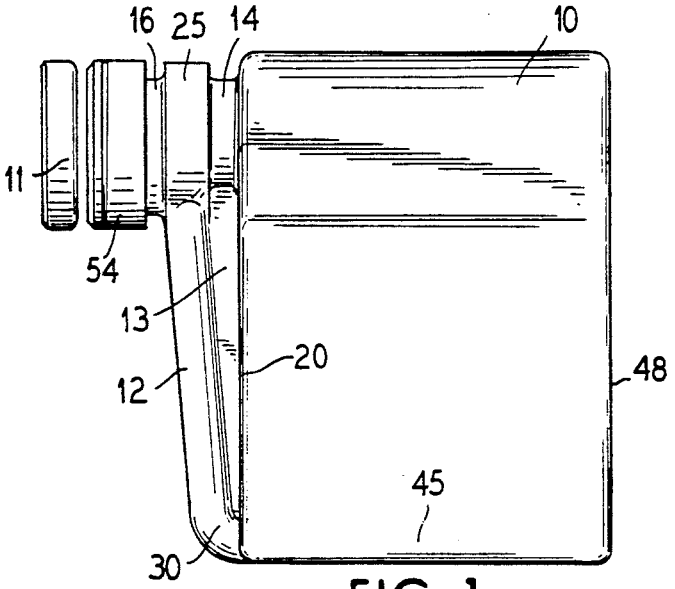
FIG. 1 is a side plan view of the dispensing bottle of the invention.
Figure 2:
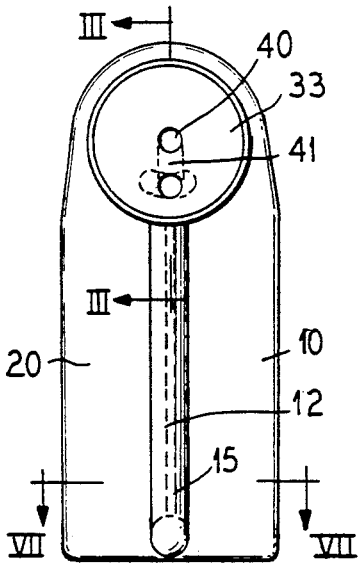
FIG. 2 is a top plan view of the dispensing bottle.
Figure 7:
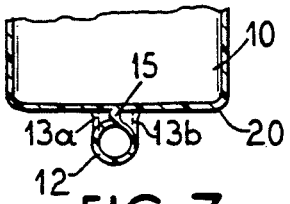
FIG. 7 is a sectional view taken on line VII—VII from FIG. 2.

FIGS. 1 and 2 illustrate a container which has a main body portion 10 in which is contained a liquid product which is to be dispensed. A dispensing tube 12 is connected to the top 20 of the container 10 by integrally formed ribs 13*a*, 15 and 13*b* as illustrated in FIG. 7, for example. The end 30 of tube 12 passes through the top 20 of container 10 and extends within the container 10 adjacent the bottom 45. The container 10 may be set upon its bottom 45 or its side 48.

Figure 3:
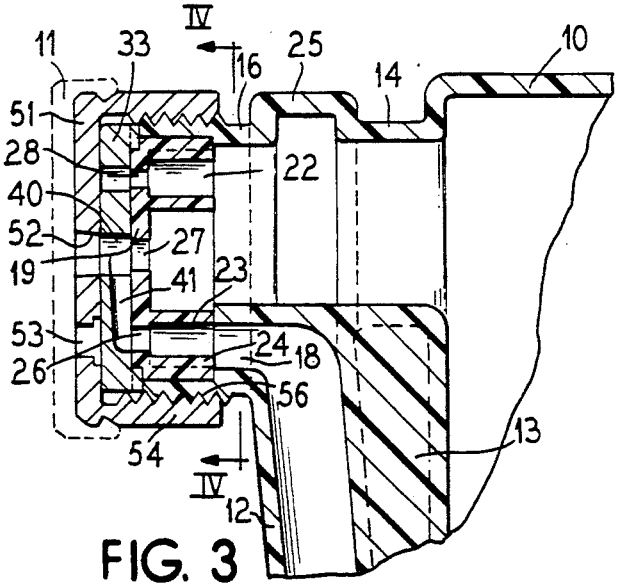
FIG. 3 is a sectional view through the dispensing portion of the container.
Figure 4:
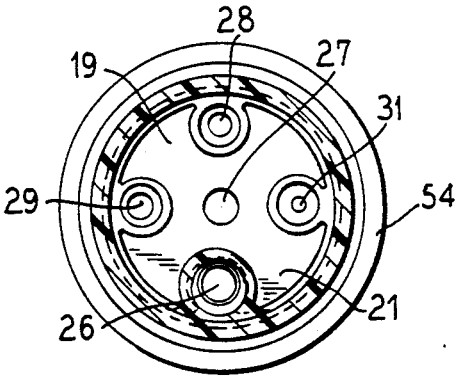
FIG. 4 is a sectional view taken on line IV—IV in FIG. 3.
Figure 6:
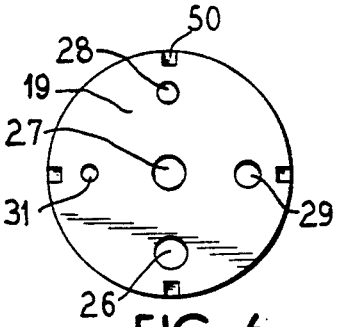
FIG. 6 illustrates another of the dispensing washers.

A cylindrical portion 14 has an opening which communicates with the inside of the container as shown, for example, in FIG. 3 and has an enlarged portion 25 to which the tube 12 is connected. The hollow tubular portion 16 is connected to the portion 25 and has its upper end formed with threads 56 which threadedly receives a cap member 54. A sleeve shaped member 19 is received in the upper end of member 16 and is formed with a first passageway 26 which communicates with the upper end 18 of tube 12. An opening 27 communicates with the hollow passage through the members 16, 25 and 14 with the inside of container 10. As shown in FIGS. 4 and 6, the member 19 has a surface 21 which is formed with four openings of different sizes 26, 28, 29 and 31 which are spaced 90 degrees apart relative to each other and symmetrical about the center opening 27.

Figure 5:
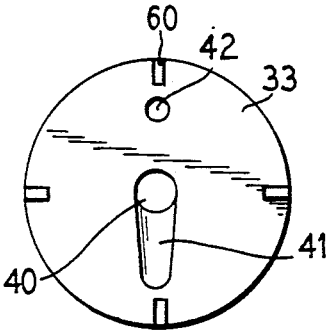
FIG. 5 illustrates one of the dispensing washers.

A disc-shaped member 33 is mounted adjacent the member 19 and is shown in detail in FIG. 5 and is formed with a slot 41 and has a central opening 40. A member 51 is generally cylindrical shaped and has a cylindrical portion 54 which is internally threaded which mates with the externally threaded portion 56. The member 51 is formed with the central opening 52 which communicates with the opening 40. Openings 40 and 27 align to provide a through passage. The member 51 is also formed with an opening 53 that can be rotated to align with openings and 22. A cover member 11 can be detachably mounted over the end of the member 51 to close the opening 52 to prevent material from being dispensed from the container.

In use, the lid 11 is removed from the top of member 51 and in the position shown in FIG. 3 where the slot 41 extends from opening 26 to the central opening 27 and 52, when the squeeze bottle is compressed by the user, the liquid product in the container will pass through the tube 12 through openings 18, 23, 26 and slot 41 to the discharge openings 40 and 52. Simultaneously, air in the container will pass thorough opening 27 and discharge opening 52 where it will mix with the liquid product passing through tube 12 at 40 and will be dispensed in the form of a mist.

For filing the bottle, the lid 11 and the member 51 is removed and liquid product is placed into the container 10 through the openings of neck 14, 25 and 16. After the container has been substantially filled, then the members 19 and 33 are inserted and the cap 51 is screwed onto the threaded portion 56 after which the lid 11 is placed over the cap 51 to close the opening 52.

The quantity of liquid product being dispensed can be adjusted by moving the member 19 so that the various size openings 26, 28, 29 and 31 communicate with the slot 41 formed in the member 33. The opening 31, for example, is the smallest opening and if this opening is aligned with the slot 41 then the smallest quantity of liquid will be supplied as the container is depressed. Alternatively, the opening 26 is the largest opening for the product and if this is aligned with the slot 41, the largest quantity of liquid product will be supplied. Openings 28 and 29 allow intermediate quantities of products to be discharged. Index slots 50 can be aligned with projections 60 on member 33 to select the different size openings allow the member 19 to be rotated.

Since the tube extends into the container 10, it is not necessary to shake the container before dispensing.

Various products can be dispensed such as cosmetics including liquid soap, lotions and shampoos. Food, such as any liquid food product such as oil, ketchup, mustard or water can be dispensed. Also, cleaners such as window cleaners, detergents and wax can be dispensed with the novel container of the invention.

If liquid without air is to be dispensed member 33 can be rotated 180 degrees from that shown in FIG. 3. During this use, the liquid would pass through opening 26, 42 and 53 and would not be aeriated.

Although the invention has been described with respect to preferred embodiments, it is not to be so limited as changes and modifications can be made which are within the full intended scope of the invention as defined by the appended claims.

I claim as my invention:

1. A dispensing container for a liquid product comprising, a flexible container, an outlet neck extending from a top portion of said flexible container, a tube integrally formed with said flexible container and extending from said outlet neck to and in fluid communication with the bottom of said container, and a mixing device connected to said tube and to said outlet neck so as to mix air with said liquid product as said container is squeezed, wherein said mixing device includes a first member with a first opening into said container and a second member with a second opening in communication with said tube and with said first opening, and wherein said second member is formed with at least a third opening which has a different size than said second opening and said second member moveable relative to said first member so that either said second or third openings can be aligned with said tube.

2. A dispensing container according to claim 1 including a cover member receivable over said second member and formed with a fourth opening which is aligned with said first opening.

3. A dispensing container according to claim 1 including a lid receivable over said mixing device.

4. A dispensing container according to claim 1 wherein said first and second members are rotatable relative to each other.

5. A dispensing container according to claim 4 including index means on said first and second members for angularly positioning said first and second members relative to each other.

* * * * *